US006931897B2

(12) United States Patent
Talpe

(10) Patent No.: US 6,931,897 B2
(45) Date of Patent: Aug. 23, 2005

(54) LOCK FOR A SLIDING DOOR OR GATE

(76) Inventor: Joseph Talpe, Oudenaardsesteenweg 543, B-8581 Avelgem-Kerkhove (BE)

( * ) Notice: Subject to any disclaimer, the term of this patent is extended or adjusted under 35 U.S.C. 154(b) by 0 days.

(21) Appl. No.: 10/364,812

(22) Filed: Feb. 11, 2003

(65) Prior Publication Data

US 2003/0150247 A1 Aug. 14, 2003

(30) Foreign Application Priority Data

Feb. 11, 2002 (EP) ..... 02447021

(51) Int. Cl.[7] ..... B60R 25/02

(52) U.S. Cl. ..... 70/210; 292/340; 292/215; 292/224

(58) Field of Search ..... 70/210; 292/340, 292/341, 341.11, 341.13, 240, 219, 213–215, 220, 224

(56) References Cited

U.S. PATENT DOCUMENTS

| | | | | | |
|---|---|---|---|---|---|
| 554,701 | A | * | 2/1896 | Krupp | 292/57 |
| 1,967,627 | A | * | 7/1934 | Riley et al. | 292/341.15 |
| 2,486,003 | A | * | 10/1949 | Christensen | 292/59 |
| 2,946,612 | A | * | 7/1960 | Ahlgren | 292/17 |
| 3,086,803 | A | * | 4/1963 | Wilson | 292/17 |
| 3,094,347 | A | * | 6/1963 | May | 292/228 |
| 3,638,285 | A | * | 2/1972 | Sanchez Giraldez | 24/108 |
| 3,776,580 | A | * | 12/1973 | James | 292/17 |
| 4,022,504 | A | * | 5/1977 | Anderson | 292/340 |
| 4,159,138 | A | | 6/1979 | Smith | 292/214 |
| 4,213,230 | A | * | 7/1980 | Hoen | 24/580.1 |
| 4,250,599 | A | * | 2/1981 | Nagashima et al. | 24/326 |
| 4,597,599 | A | * | 7/1986 | Bisbing | 292/174 |
| 4,796,930 | A | * | 1/1989 | Baynes | 292/58 |
| 5,226,302 | A | * | 7/1993 | Anderson | 70/159 |
| 6,149,213 | A | * | 11/2000 | Sokurenko et al. | 292/340 |
| 6,357,078 | B1 | * | 3/2002 | Marzolf et al. | 16/82 |
| 6,607,224 | B2 | * | 8/2003 | Hodges | 292/303 |

FOREIGN PATENT DOCUMENTS

| | | |
|---|---|---|
| DE | 1 553 597 | 12/1969 |
| GB | 1111513 | 5/1968 |

* cited by examiner

*Primary Examiner*—Suzanne Dino Barrett
(74) *Attorney, Agent, or Firm*—DLA Piper Rudnick Gray Cary US LLP

(57) ABSTRACT

The lock comprises a frame (5), at least one bolt (4), in particular a latch bolt which projects in a predetermined direction out of the frame, a bolt operating mechanism (26, 31, 32) and means (20, 24) for mounting at least one hand operated actuating element (21) for said bolt operating mechanism on the frame so that this actuating element can rotate on the frame according to a rotation axis (25) extending in particular perpendicular to said predetermined direction. The bolt (4) comprises a shaft portion (38) and at least one laterally projecting lock wing (39) and is rotatably mounted on the frame according to a further rotation axis (37) extending in said predetermined direction, the bolt operating mechanism being arranged to rotate the bolt (4) between a first angular orientation, wherein the lock wing (39) of the bolt is in the locking position, and a second angular orientation, wherein the lock wing of the bolt is in the unlocking position.

19 Claims, 9 Drawing Sheets

LOCK FOR A SLIDING DOOR OR GATE

RELATED APPLICATION

This patent application claims priority of European Patent Application No. 02447021.3, filed Feb. 11, 2002.

1. Field of the Invention

The present invention relates to a lock for a sliding door or gate comprising a frame; a latch bolt comprising a shaft portion and at least one laterally projecting wing on the shaft portion, the shaft portion projecting in a predetermined direction out of the frame and being rotatably mounted on the frame according to a rotation axis extending in said predetermined direction; and a latch bolt operating mechanism arranged to rotate the latch bolt from a first angular orientation, wherein the lock wing of the bolt is in a locking position, to a second angular orientation, wherein the lock wing of the bolt is in an unlocking position and vice versa, the latch bolt operating mechanism comprising a resilient element arranged to urge the latch bolt from its second to its first angular orientation.

2. Background

In practice locks for sliding doors or gates are known, the bolts of which are hook-shaped latch bolts which can pivot about an axis in order to hook behind a reception element on the opposite door post to lock the door. As actuating elements door knobs or handles are provided which can rotate about an axis parallel to the rotation axis of the hook-shaped bolt. By rotating the door knob or handle, the hook-shaped bolt can be lifted by means of the bolt operating mechanism to unlock the door.

In this known lock a quite heavy hook-shaped latch bolt, or even a double latch bolt, must be provided. Indeed, when closing the sliding door or gate, the rebound of the door or gate against the opposite door post to which the bolt reception element is fixed may cause considerably large forces in the bolt. A drawback of such a hook-shaped latch bolt is that when mounting the lock against a profile of the door or the gate so that the bolt has to extend entirely through this profile, a quite large rectangular hole has to be made for the bolt in the profile. This is not only due to the dimensions of the latch bolt itself but also to the fact that the hook-shaped bolt must be enabled to move transversally to its longitudinal direction in the hole in the profile in order to be able to hook behind the bolt reception element to lock the door.

Instead of using a hook-shaped latch bolt which pivots about an axis to hook behind a reception element, the lock according to the present invention employs a latch bolt which comprises a shaft portion provided with at least one lock wing and which is arranged to rotate about its longitudinal axis between a locking and an unlocking position.

Such a lock is already disclosed in U.S. Pat. No. 4,159,138 and in GB-B-1 111 513.

The lock disclosed in U.S. Pat. No. 4,159,138 comprises a handle operated mechanism to rotate the latch bolt to its unlocking position in order to be able to open the door. In order to be able to close the sliding door without having to actuate the handle, the slot of the reception element is provided with a pair of side-by-side spring steel bands which are laterally displaced by the head of the latch bolt as the door is closed. A drawback of such an arrangement is that the spring steel bands can become damaged by the large rebound forces arising when closing a sliding door or gate.

The lock disclosed in GB-B-1 111 513 also comprises a handle operated mechanism to rotate the latch bolt to its unlocking position in order to be able to open the door. In order to be able to close the sliding door without having to actuate the handle, the latch bolt is surrounded by a tubular shroud member. This shroud member maintains the latch bolt in its unlocking position when the door is opened. When closing the door, the shroud member is pushed over the latch bolt so that the latch bolt can rotate towards its locking position. A drawback of such a shroud member is that it complicates the lock and that it requires a relative large construction around the latch bolt. Consequently, the lock disclosed in GB-B-1 111 513 is not suited for being mounted against an upright of a door or gate so that the latch bolt extends through this upright since a relatively large hole is needed to pass the latch bolt and the surrounding construction with the shroud member through the upright.

SUMMARY OF THE INVENTION

An object of the present invention is therefore to provide a new type of lock for a sliding door or gate which enables to close the door or gate without having to operate the handle and this without requiring spring steel bands in the reception element to allow the head of the latch bolt to pass or a shroud member around the latch bolt to keep it in its unlocking position once the door or gate has been opened.

To this end, the lock according to the invention is characterised in that the wing has a lateral surface forming an angle with a straight line parallel to the rotation axis of the latch bolt enabling to convert a translational motion of the latch bolt in said predetermined direction into a rotational motion of the latch bolt from its first to its second angular orientation.

In order to lock the door or gate, the bolt has not to be lifted or moved transversally to its longitudinal direction but can simply be rotated about its longitudinal axis. An advantage of such a lock is that when mounting the lock against one side of a profile of the door or gate so that the bolt extends through this profile only a relatively small cylindrical hole must be provided in this profile for receiving the shaft portion of the bolt. It is clear that such a hole can easily be drilled in the profile. A further advantage of the lock according to the invention is that, when closing the door or gate, the latch bolt is automatically rotated to its unlocking position by mechanical contact between the lateral surface of the lock wing and the reception element, in particular with the slot therein. In this way, the lateral edges of the slot in the reception element do not have to be elastic to allow the head of the latch bolt to pass or no shroud member has to be provided around the latch bolt to keep it in its unlocked state when having opened the door or gate. The latch bolt structure of the lock according to the invention can therefore be kept quite compact and a strong connection with the reception element can be obtained which can resist the high rebound forces arising when slamming a sliding door or gate.

In a preferred embodiment of the lock according to the invention, the latch bolt is made of at least a first and a second part which are removably fixed to one another, the first and second parts being preferably provided with a screw thread by means of which they are screwed onto one another, the first part comprising at least a head portion which shows said lock wing.

In this embodiment, after having removed the first part with the head portion, the latch bolt can easily be applied through a small hole in a profile and the first part can subsequently be mounted again onto the free extremity of the second part which projects out of the profile. The first part is preferably screwed onto the second part in order to be able to resist the high traction forces which may occur as a result of the rebound of the sliding door or gate against the door post when closing it.

In a further preferred embodiment of the lock according to the invention, the shaft portion of the bolt has an end portion by means of which it is rotatably mounted in the frame, which end portion is provided with a collar engaging the back side of a cover plate of the lock through which the bolt projects out of the frame, the collar being preferably maintained in a circumferential groove formed between the cover plate and a further frame element which is rigidly united with the cover plate.

In this embodiment, the bolt is strongly fixed in the frame in order to resist the high traction forces which may occur as a result of the rebound of the sliding door or gate against the door post when closing it.

BRIEF DESCRIPTION OF THE DRAWINGS

Further advantages and particularities of the invention will become apparent from the following description of some particular embodiments of the lock according to the invention. This description is only given by way of illustrative example and is not intended to limit the scope of the invention as defined by the annexed claims. The reference numerals used in the description refer to the drawings wherein:

DETAILED DESCRIPTION

Figure 1:
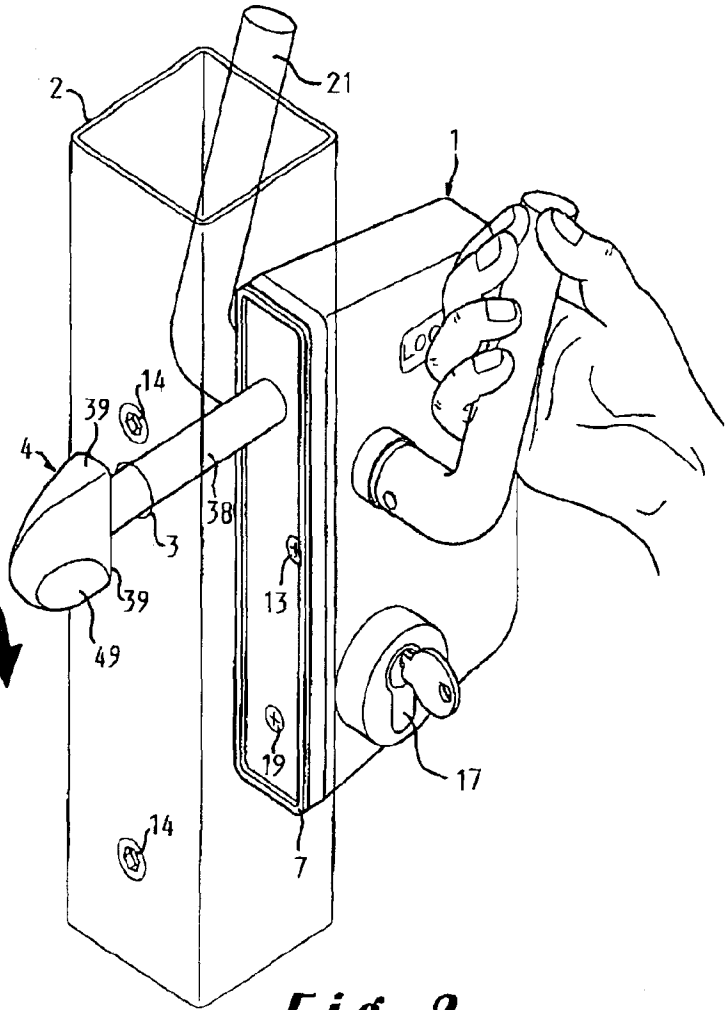
FIG. 1 is a perspective view of a lock according to the invention in the locking position of the latch bolt, the profile to which the lock is fixed is also illustrated without omitting however the portions of the lock withdrawn from view by the profile.
Figure 2:
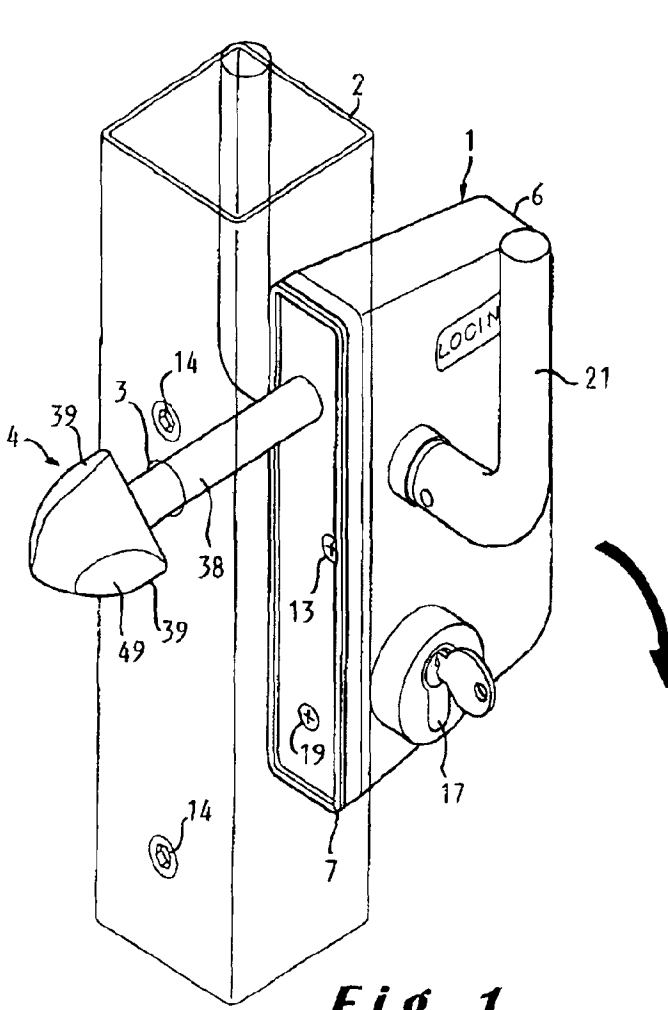
FIG. 2 is a view similar to FIG. 1 but showing the latch bolt in its unlocking position by actuating one of the handles.

The lock 1 shown in the drawings is a lock provided to be mounted against a profile 2, in particular a tubular profile, of a sliding door or gate. In the present specification, the term door is intended to embrace doors, gates and any other similar closure structure. The profile 2 is provided with a cylindrical hole 3 so that the latch bolt 4 of the lock 1 can project there through. This latch bolt 4 can be rotated by means of the handles from the locking position illustrated in FIG. 1 to the unlocking position illustrated in FIG. 2.

The illustrated lock 1 comprises a frame 5 composed of a cover box 6, a front cover plate 7 for closing the box 6 and a base plate 8 arranged within the closed box 6. The base plate 8 has on its front side an upstanding edge 9 and on its back side a further upstanding edge 10. The cover box 6 has such dimensions that the base plate 8 can be slid completely therein, more particularly through the substantially rectangular front opening 11 of the box 6, even the front upstanding edge 9.

The cover plate 7 is somewhat larger than the front opening 11 so that it engages against the peripheral edge thereof. By means of screws 12 the upstanding edge 9 of the base plate 8 is fixed to the cover plate 7. The cover box 6 is then fixed by means of a screw 13 to the base plate 8 and the front cover plate 7. By means of the screws 14, and the spacers 15 applied thereover, the lock 1 can be fixed laterally to the tubular profile 2 of the door or gate.

The cover box 6 is provided with two aligned openings 16 through which a key operated cylinder 17 can be inserted in the lock 1, in particular a so-called Euro-cylinder corresponding to the standard DIN V18254/07.91. This key actuated cylinder 17 comprises a rotary driving bit 18 which rotates around a central axis of the cylinder. The cylinder 17 is fixed in the lock 1 by means of a screw 19 passing through little holes made in the cover plate 7 and in the upstanding edge 9 of the base plate 8. The cover box 6 is further provided with two additional aligned openings 20 wherein the door handles 21 can be mounted. As usual these handles 21 are mounted onto a square handle shaft 22 onto which they are fixed by means of set screws 23.

The handle shaft 22 is inserted in the hole of a follower 24. This hole has a square cross-section corresponding to the cross-section of the handle shaft 22 so that the follower can be rotated by means of the handles. Both the follower 24 and the handle shaft 22 can thus rotate on the frame according to a rotation axis 25. In the lock according to the invention, this rotation axis 25 forms an angle with the direction into which the bolt 4 projects out of the frame 5 or with the rotation axis 37 of the bolt. Both rotation axes 25 and 37 preferably form an angle of about 90°.

Figure 3:
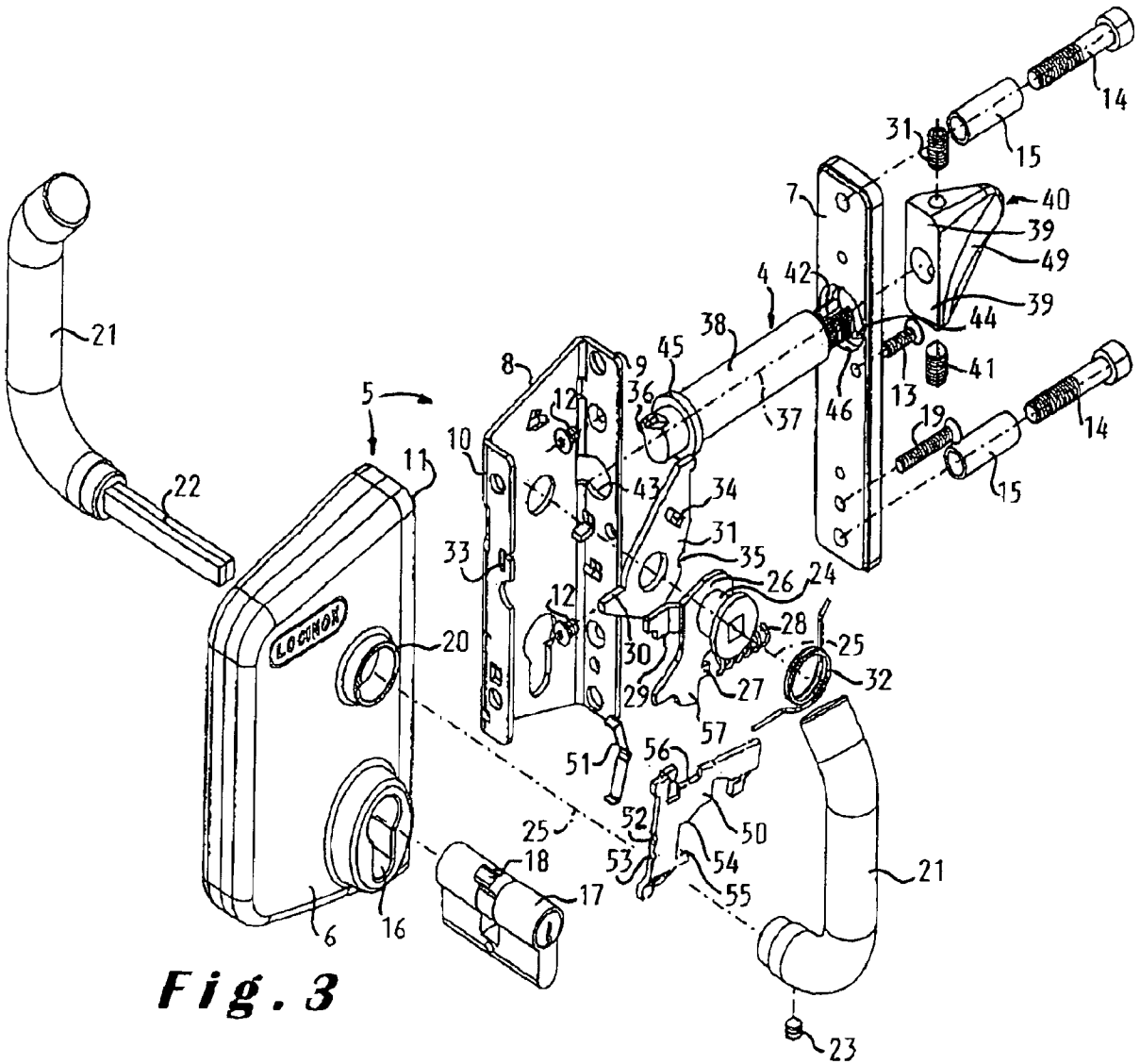
FIG. 3 is an exploded view of the lock illustrated in the previous figures.
Figure 5:
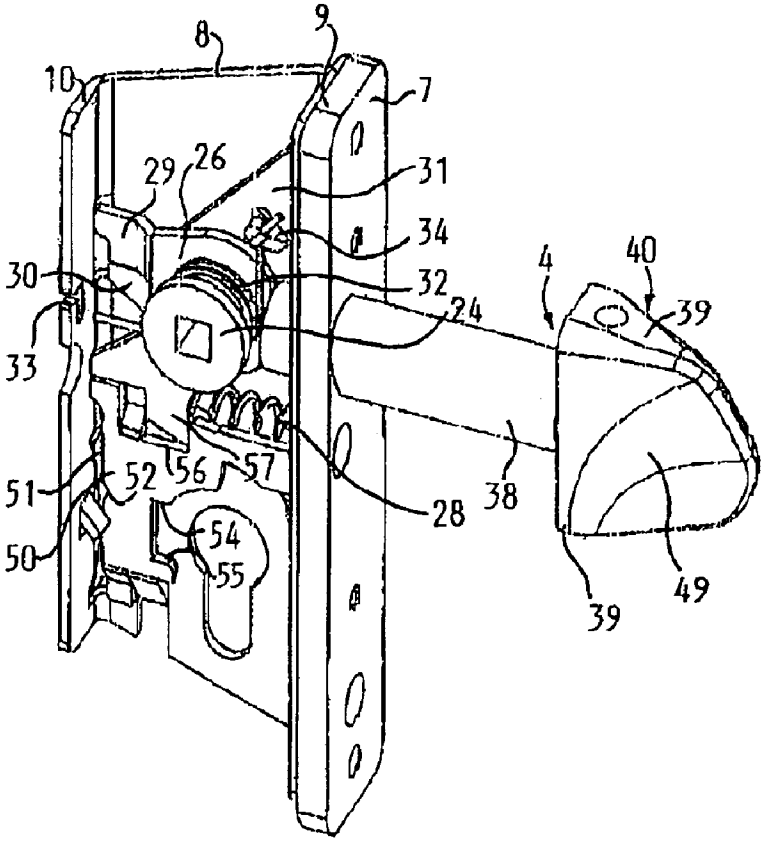
FIGS. 4 and 5 are perspective views on a basic part of the lock.

The bolt operating mechanism which enables to convert a rotation of the handles about their rotation axis 25 into a corresponding rotation of the latch bolt 4 about its rotation axis 37 comprises first of all a first latch bolt lever 26 mounted, in particular rigidly fixed on the follower 24 to follow the rotary movements thereof. This first latch bolt lever 26 shows a projection 27 which is inserted into a coil spring 28 arranged between the first latch bolt lever 26 and the upstanding edge 9 of the base plate 8 to urge the handles to their rest position. The first latch bolt lever 26 further shows an abutment 29 which engages an abutment 30 on a second latch bolt lever 31 and thus enables to rotate the second latch bolt lever 31 (anticlockwise in FIGS. 3 to 5) from a first angular orientation or rest position thereof to its second angular orientation. In contrast to the first latch bolt lever 26 the second latch bolt lever 31 is rotatably mounted onto the follower 24 so that it can rotate independently from the follower 24 according to the rotation axis 25 of the handles 21. To maintain the second latch bolt lever 31 in its first angular orientation, a coil spring 32 is arranged around the follower 24. This coil spring 32 has one end engaged in a slot 33 in the upstanding edge 10 of the base plate 8 and has its other end applied behind a projection 34 on the second latch bolt lever 31. Instead of providing such a torsion coil spring 32, it is also possible to provide a compression coil spring which is applied, in a same way as the compression coil spring 28, between the projection 34 and the upstanding edge 10.

The second latch bolt lever 31 engages the latch bolt 4 to rotate it between a first angular orientation (illustrated in FIG. 1) wherein the latch bolt is in the locking position and a second angular orientation (illustrated in FIG. 2) wherein the latch bolt is in the unlocking position. The second latch bolt lever 31 more particularly comprises a first crown wheel portion 35 and the latch bolt a second crown wheel portion 36 engaging each other so that when the second latch bolt lever 31 is in its first angular orientation, the latch bolt 4 is also in its first angular orientation and, vice versa, when the second latch bolt lever 31 is in its second angular orientation, the latch bolt 4 is also in its second angular orientation. Since only a small angular relocation is required, it is clear that both the second latch bolt lever 31 and the latch bolt 4 itself have to show only one or two mutually engaging notches or teeth.

The latch bolt 4 comprises a shaft portion 38 and at least one laterally projecting lock wing 39. The illustrated bolt 4 comprises more particularly two lock wings 39 which project in opposite directions. The two lock wings 39 are formed by a head portion 40 of the bolt which is removably fixed onto the free extremity of the shaft portion 38. Preferably both the shaft portion and the head portion are screw threaded so that a strong connection is obtained which can resist to the possible rebound forces when closing the door. The angular orientation of the head portion 40 with respect to the shaft portion 38 is fixed by means of set screws 41 screwed through holes in the head portions into a groove 42 provided in the end face of the shaft portion 38. Instead of, or in addition to fixing the head portion 40 removably onto the shaft portion 38, the shaft portion 38 can also be divided into two parts which are screwed onto one another. An advantage of this embodiment is that, when having removed the shaft portion with the head 40, the remaining portion of the shaft 38 projects over a smaller distance out of the front plate so that the lock can be fixed more easily to the profile of the door (less space is required to manipulate the lock with the projecting shaft portion into the hole in the profile).

The shaft portion 38 extends at its extremity opposite the head portion through openings 43 and 44 in the cover plate 7 and in the upstanding edge 9 of the base plate 8. For securing the shaft portion 38 to the frame of the lock, its extremity opposite the head portion shows a collar 45 whilst behind the opening 43 in the cover plate a recess is provided in the back side of this plate forming a groove 46 between the cover plate and the upstanding edge to receive the collar 45. In this way, the shaft portion can rotate in the openings 43 and 44 and is strongly secured between the upstanding edge and the front plate by means of the collar 45.

Figure 10:
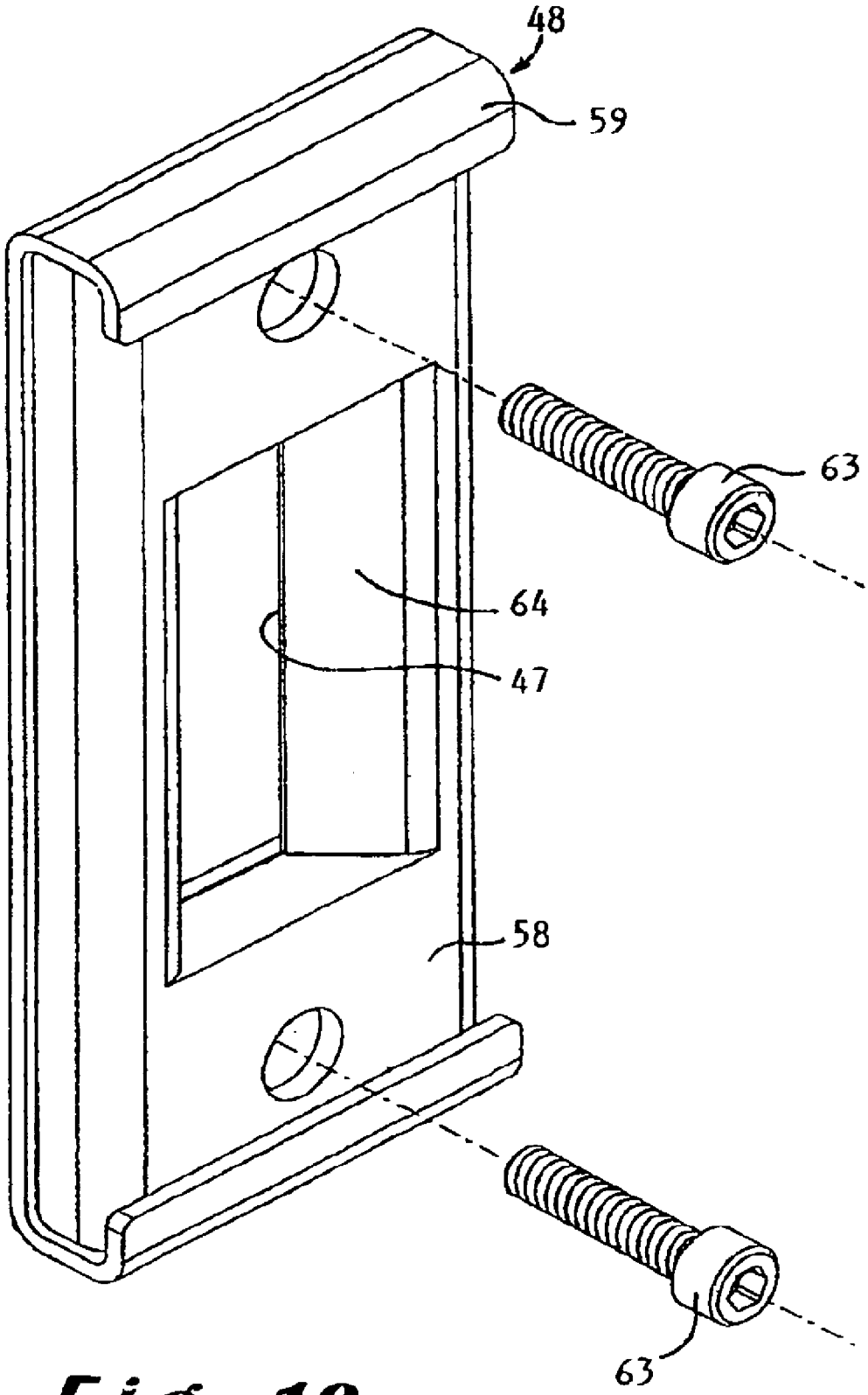
FIG. 10 is a perspective view of an alternative bolt reception element according to the invention.
Figure 11:
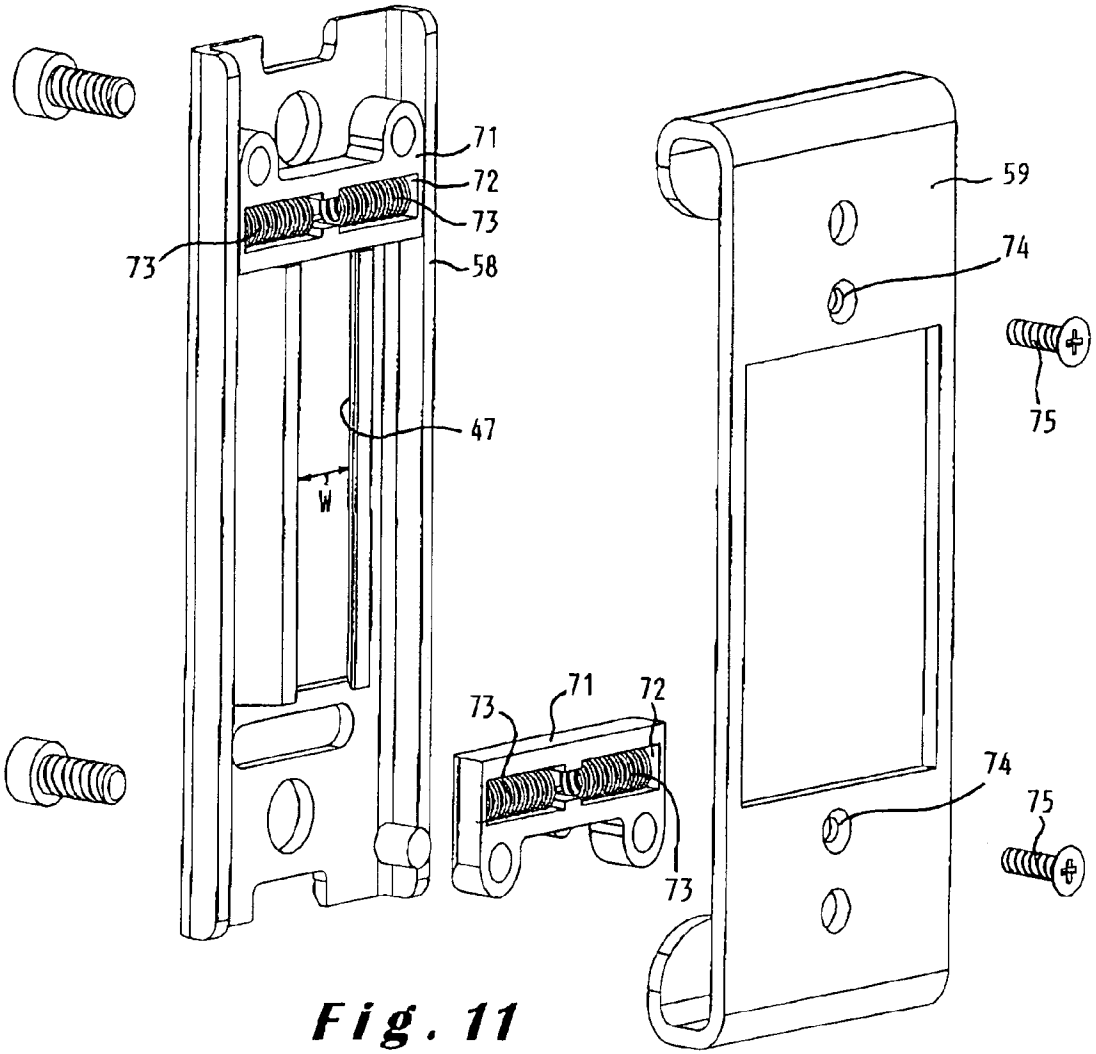
FIG. 11 is an exploded view of the bolt reception element illustrated in FIG. 10.
Figure 12:
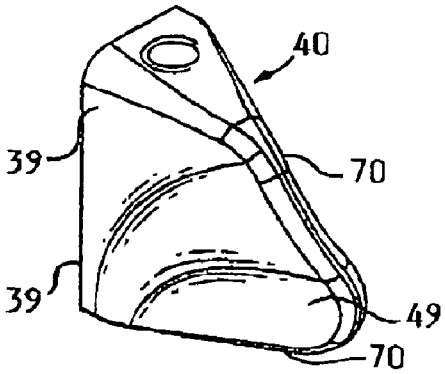
FIG. 12 is, on a larger scale, a perspective top view on the head of the latch bolt from the lock illustrated in FIGS. 1 to 5.
Figure 13:
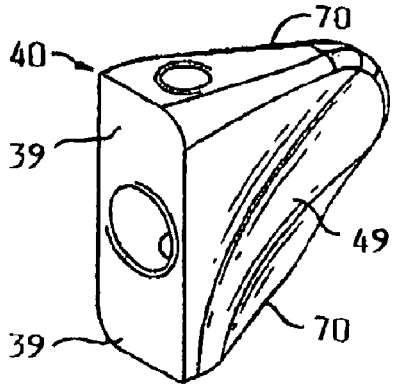
FIG. 13 is a same perspective top view as FIG. 12 but from a different angle.
Figure 14:
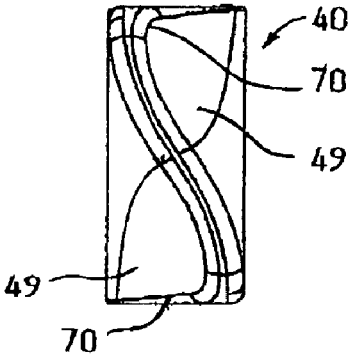
FIGS. 14 to 16 are a front elevational view, a side elevational view and, respectively, a top plan view on the head illustrated in FIGS. 12 and 13.
Figure 15:
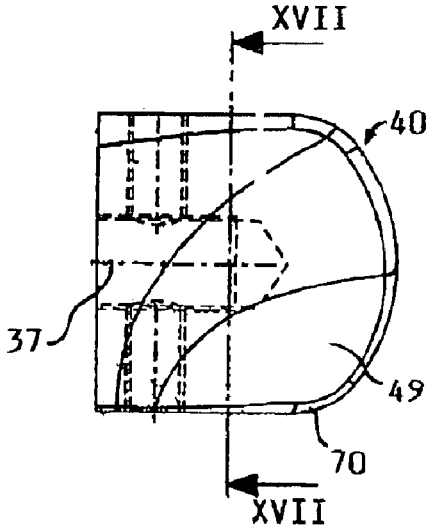
Figure 16:
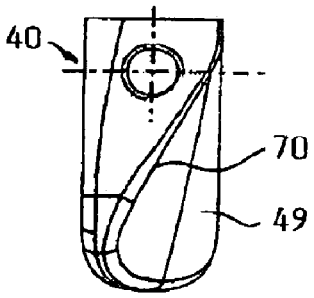
Figure 17:
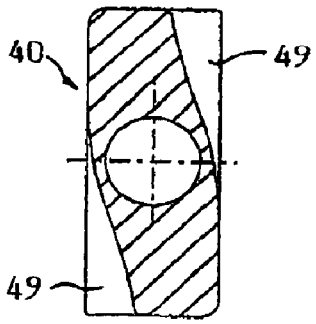
FIG. 17 is a sectional view according to lines XVII—XVII in FIG. 15.

To lock the door or gate, the head portion of the above described lock is arranged to be inserted through a slot 47 in a bolt reception element 48, in particular in a bolt reception element illustrated in FIGS. 6 to 9 or in a bolt reception element illustrated in FIGS. 10 and 11. The slot 47 in this bolt reception element 48 has a width w such that the bolt can be guided through this slot in its second angular orientation and that in its first angular orientation the lock wing or wings secure the bolt behind the slot 47 in the bolt reception element. In order to avoid having to actuate the handles to be able to insert the bolt 4 into the slot 47, the lock wings 39 of the illustrated bolt have a lateral surface 49 defining a screw-like curve 70 around the rotation axis 37 of the latch bolt 4. The screw-like curve 70 is more particularly defined by the line of contact between the lateral surface 49 of the lock wing 39 and the edge 64 of the slot 47 in the bolt reception element when the latch bolt is inserted in this reception element. Due to the screw-like shape of this curve 70 the translational motion of the latch bolt is converted into a rotational motion thereof, more particularly in a rotation from the first angular orientation of the latch bolt (locking position) to its second angular orientation (unlocking position). Once inserted in the slot, the bolt 4 resumes its first angular orientation or locking position by the action of the coil spring 32 urging the second latch bolt lever 36 and therefore the latch bolt itself to their first angular orientations.

FIGS. 12 to 17 illustrate a preferred embodiment of the head 40 of the latch bolt 4 comprising two opposite lock wings 39. Both the upper and the lower lock wings 39 have one side which is plough-shaped 49, the upper lock wing on one side and the lower lock wing on the opposite side. As can be seen in the front elevational view of FIG. 14, the front edge of the latch bolt which is thus obtained is generally S-shaped when seen in front view. Such a shape corresponds substantially to a propeller shape.

The line of contact between the lock wings and the slot in the reception element, or in other words the above described screw-like curve, is preferably defined by the edge of the lateral surface of the lock wings. In this way the torsional forces achieved by the translational motion of the latch bolt can be maximised (due to the greater distance from the rotation axis 37). In a preferred embodiment, the screw-like curve defined by the lateral surface of the lock wing or wings has a pitch which is greater than 150 mm, more preferably greater than 180 mm and most preferably greater than 210 mm. The larger the pitch, the more easily the translational motion of the latch bolt can be converted into a rotational motion. However, the pitch of the screw-like curve should preferably not be too large since this would require a too large length of the lock wings for achieving a predetermined angular rotation. For achieving an angular rotation of 45° with a pitch of 240 mm, the head of the latch bolt has to have for example a length of about 30 mm. The pitch should therefore preferably be smaller than 350 mm, and more preferably smaller than 300 mm.

For locking the lock by means of the key operated cylinder in this position, the lock illustrated in the drawings comprises a retaining element 50 and an accolade-shaped leaf spring 51 arranged between the retaining element 50 and the upstanding edge 10 of the base plate 8 and having its free extremities fixed into slots in the upstanding edge 10. The retaining element 50 can slide on this base plate 8 between an upper position and a lower position and shows an upper notch 52 for maintaining the retaining element 50 by means of the leaf spring 51 in its upper position and a lower notch 53 for maintaining this element by means of the spring 51 in its lower position. The retaining element 50 shows further a first abutment 54 for lifting it to its upper position by means of the rotary driving bit 18 of the cylinder 17 and a second abutment 55 for lowering it again by means of the rotary driving bit 18 to its lower position. At its top, the retaining element 50 shows a retaining notch 56 arranged to enclose in the upper position of the retaining element 50 a projecting part 57 of the first latch bolt lever 26 to prevent any rotation thereof and to release this projecting part 57 in the lower position of the retaining element 50.

FIGS. 6 to 9 illustrate a preferred embodiment of a bolt reception element which can be used to secure the bolt of a lock according to the present invention. This bolt reception element 48 comprises a front plate 58 wherein the slot 47 for the bolt is provided. The front plate 58 is maintained by means of a C-shaped holding element 59 against the open front side of a tubular carrier element 60, fixed by means of screws 63 against or in the post or wall against which the sliding door or gate abuts. The free extremities of the C-shaped holding element 59 extend in front of the front plate 58 and allow a lateral displacement of the front plate, more particularly in a direction perpendicular to the longitudinal direction of the slot 47. Within the tubular carrier element 60 U-shaped leaf springs 61, the legs of which have such a length that they project out of the open front side into a groove 62 in the back of the front plate. In this way, when the front plate 58 has been slid aside and is released again, the leaf springs 61 will centre the front plate 58 again in front of the open front side of the carrier element 60.

An advantage of this embodiment is that the door has not to be exactly aligned in front of the bolt reception element 48 in order to be able to insert the bolt in the slot 47. When closing the door or gate, the front plate 58 will indeed be centred automatically in front of the bolt either by the pointed shape of the bolt or, as illustrated in the drawings, by the bevelled longitudinal edges 64 of the slot 47 in the front plate 58. An important advantage of this embodiment is further that the head portion 40 of the bolt 4 may have a width which is substantially equal to the width w of the slot 47 so that lock wings 39 hook in their locking position as far as possible behind the front plate 58.

An alternative embodiment of the bolt reception element is illustrated in FIGS. 10 and 11. This bolt reception element also comprises a C-shaped holding element 59, which can be fixed by means of screw 63 against or in the wall or post, and a front plate 58 maintained between the arms of the C-shaped holding element 59. The slot 47 with bevelled edges 64 in the front plate is similar to the slot in the front plate of the previous embodiment. A difference with the previous embodiment is that the back side of the front plate 58 is provided with an upper and a lower plastic insert 71 showing each a transverse groove 72 forming each two opposite compartments containing a compression spring 73. The C-shaped holding element 59 is provided with two threaded holes 74 for screws 75. The holes 74 are located so that the screws 75 project into the groove 72 between the two compression springs 73. In this way, the front plate 58 can be pushed aside against the action of one of the compression springs 73 but will always return to the equilibrium position. Compared to the previous embodiment, the C-shaped holding element 48 can have a considerably reduced thickness.

Based on the hereabove given description of a preferred embodiment of the lock according to the invention, the working thereof will be immediately apparent.

When closing the sliding door or gate, the head portion 40 of the latch bolt 4 engages one of the bevelled longitudinal edges 64 of the slot 47 in the front plate 58 of the bolt reception element 48 and centres this front plate in front of the latch bolt 4. When entering the slot 47, the side surfaces of the lock wings 39 engage the edge of the slot 47 along the screw-like curve 70 and cause the latch bolt 4, and therefore also the second latch bolt lever 31, to rotate against the force of the latch bolt spring 32, without rotating however the first latch bolt lever or the handles. Once inserted in the slot 47, the latch bolt spring 32 urges the second latch bolt lever 31 and the latch bolt 4 again to their rest position wherein the latch bolt is in its locking position. In this position, the retaining element 50 can be lifted by means of the key operated cylinder to prevent any rotation of the door handles in order to lock the door.

Figure 4:
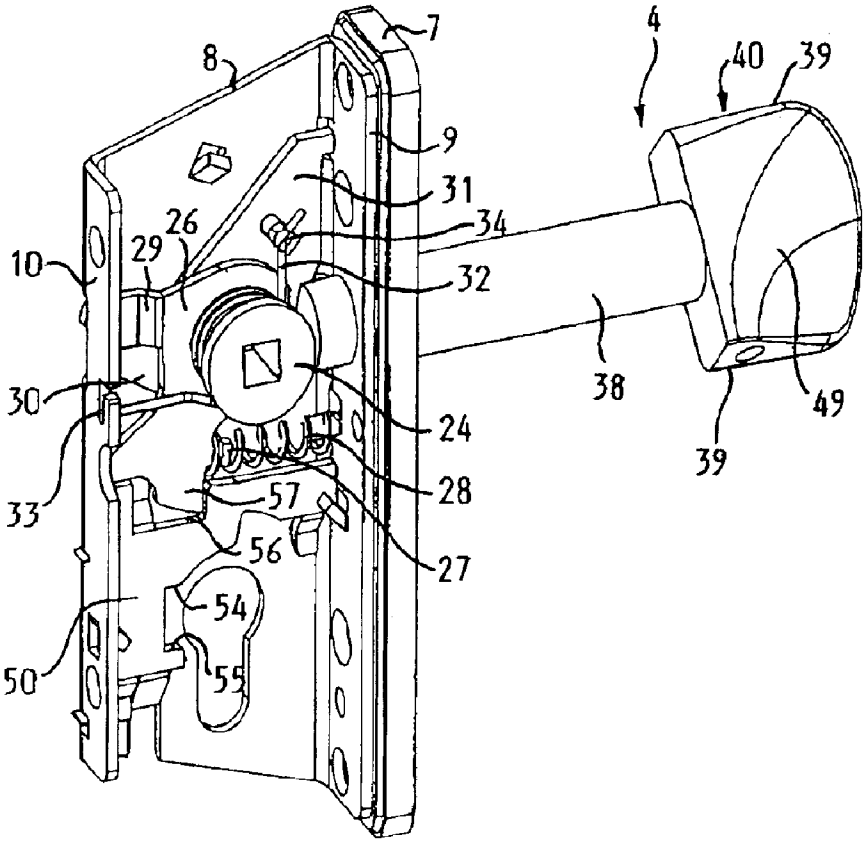
Figure 8:
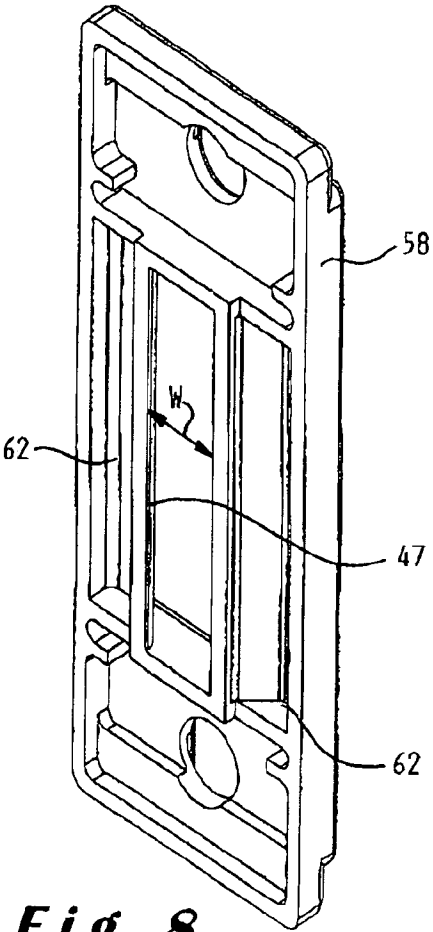
FIG. 8 is a perspective view of the back side of the cover plate of the bolt reception element illustrated in FIGS. 6 and 7.
Figure 6:
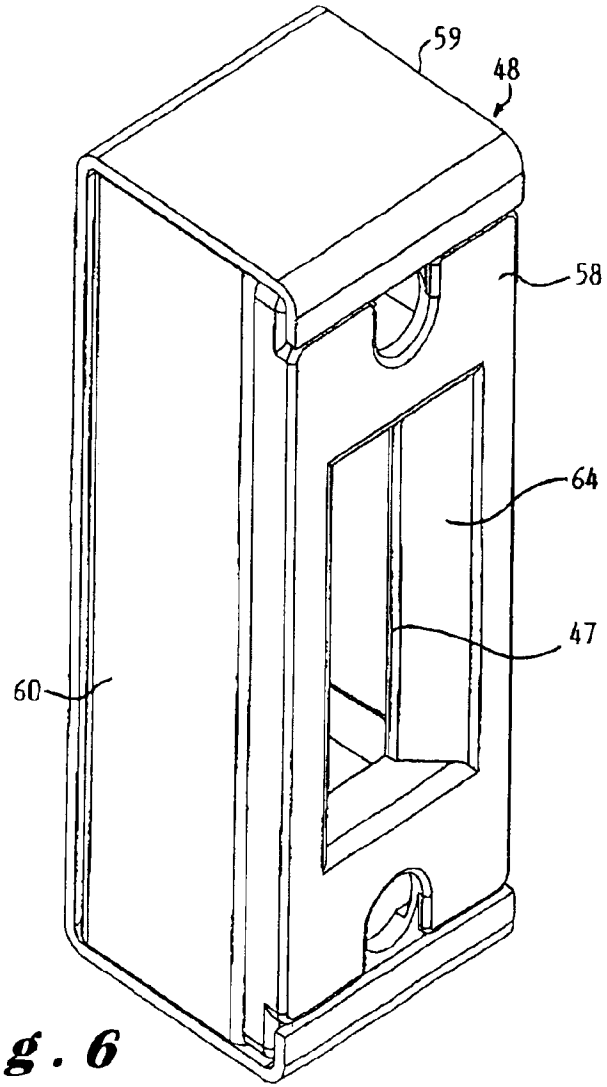
FIG. 6 is a perspective view of a bolt reception element according to the invention.
Figure 7:
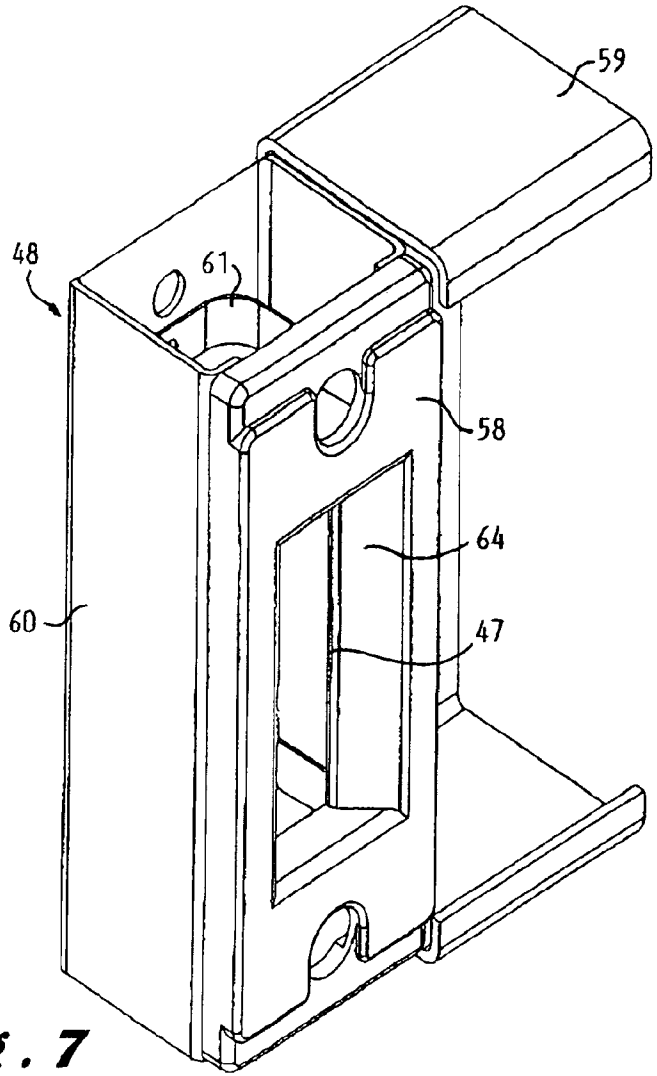
FIG. 7 is a view similar to FIG. 6 but having the holding element of the cover plate of the bolt reception element slid aside.
Figure 9:
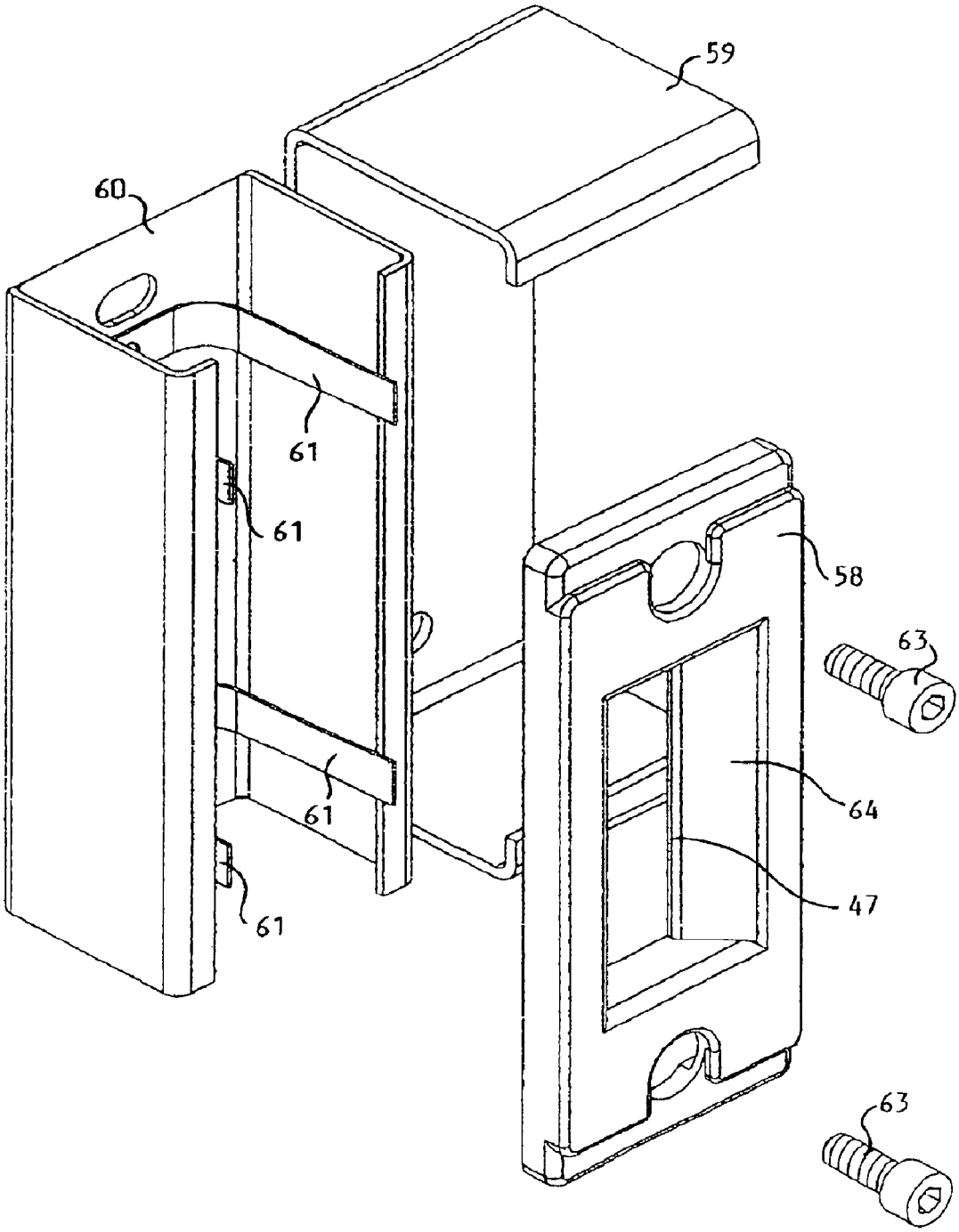
FIG. 9 is an exploded view of the bolt reception element illustrated in FIGS. 6 to 8.

To unlock and open the door, the retaining element 50 has first to be lowered again by rotating the key in the opposite direction. Subsequently, one of the handle can be actuated to rotate the first latch bolt lever 26 and at the same time the second latch bolt lever 31. The rotation of the second latch bolt lever 31 causes a corresponding rotation of the latch bolt itself from its locking to its unlocking position. In this way, by pulling on the handle, the sliding door or gate can be opened. As can be seen in FIG. 4, the shaft portion 38 of the latch bolt 4 has a width which is somewhat larger than the width of the head portion 40, more particularly in such a manner that the shaft portion 38 projects somewhat beyond the lateral sides of the head portion 40. In this way, even when one of the edges 64 are pushed by the springs 61 or 73 against the shaft portion 38, the head portion 40 can easily be removed out of the slot 47 in the bolt reception element 48, i.e. the head portion 40 will not become stuck behind the edges 64.

An important advantage of the above described lock is that it can easily be mounted on one side of a door profile so that its bolt projects through this profile. In this case only a small cylindrical hole has to be drilled through the profile. If desired, other attachments can be provided on the lock so that it can be fixed laterally against the door or gate. In this case, the length of the shaft portion of the latch bolt can be reduced.

From the hereabove given description, it will be clear that many modifications can be applied to the described embodiment without leaving the scope of the present inventions as defined in the appended claims.

It is for example possible to design the lock so that the latch bolt may be actuated by mean of a key operated cylinder instead of, or in addition to the operation by means of one or both of the handles.

What is claimed is:

1. A lock for a sliding door or gate comprising:

a frame;

a latch bolt comprising a shaft portion and at least one laterally projecting wing on the shaft portion, the shaft portion projecting in a predetermined direction out of the frame and being rotatably mounted on the frame according to a rotation axis extending in said predetermined direction; and a latch bolt operating mechanism arranged to rotate the latch bolt from a first angular orientation, wherein the lock wing of the bolt is in a locking position, to a second angular orientation, wherein the lock wing of the bolt is in an unlocking position and vice versa, the latch bolt operating mechanism comprising a resilient element arranged to urge the latch bolt from its second to its first angular orientation, said wing having a lateral surface defining a screw-like curve around the rotation axis of the latch bolt enabling to convert a translational motion of the latch bolt in said predetermined direction into a rotational motion of the latch bolt from its first to its second angular orientation and said screw-like curve having a pitch greater than 150 mm.

2. The lock according to claim 1, wherein the lock wing is arranged to secure the latch bolt through a slot in a reception element, the lock wing being arranged to rotate the latch bolt to said second angular orientation by co-operating over said screw-like curve with an edge of said slot when being inserted in this slot.

3. The lock according to claim 1, wherein the lateral surface of the lock wing is plough-shaped.

4. The lock according to claim 1, wherein the bolt comprises two laterally projecting lock wings which project in opposite directions.

5. The lock according to claim 4, wherein the laterally projecting lock wings are substantially propeller shaped.

6. The lock according to claim 1, wherein the screw-like curve has a pitch greater than 180 mm.

7. The lock according to claim 1, wherein the screw-like curve has a pitch smaller than 350 mm.

8. The lock according to claim 1, wherein the lock further comprises means for mounting at least one hand operated actuating element for said latch bolt operating mechanism on the frame so that the actuating element can rotate on the frame according to a further rotation axis forming an angle with the rotation axis of the latch bolt.

9. The lock according to claim 8, wherein the further rotation axis is substantially perpendicular to the rotation axis of the latch bolt.

10. A lock for a sliding door or gate comprising:

a frame;

a latch bolt comprising a shaft portion and at least one laterally projecting wing on the shaft portion, the shaft portion projecting in a predetermined direction out of the frame and being rotatably mounted on the frame according to a rotation axis extending in said predetermined direction;

a latch bolt operating mechanism arranged to rotate the latch bolt from a first angular orientation, wherein the lock wing of the bolt is in a locking position, to a second angular orientation, wherein the lock wing of the bolt is in an unlocking position and vice versa, the latch bolt operating mechanism comprising a resilient element arranged to urge the latch bolt from its second to its first angular orientation, and means for mounting at least one hand operated actuating element for said latch bolt operating mechanism on the frame so that this actuating element can rotate on the frame according to a further rotation axis forming an angle with the rotation axis of the latch bolt, wherein said wing has a lateral surface defining a screw-like curve around the rotation axis of the latch bolt enabling to convert a translational motion of the latch bolt in said predetermined direction into a rotational motion of the latch bolt from its first to its second angular orientation and wherein said means for mounting the hand operated actuating element on the frame comprise a follower which is rotatably mounted according to said rotation axis onto the frame, and said bolt operating mechanism comprises a first latch bolt lever mounted irrotatably onto the follower and a second latch bolt lever which can rotate independently from the follower according to said rotation axis between a first angular orientation and a second angular orientation, the second latch bolt lever having a first crown wheel portion and the latch bolt a second crown wheel portion engaging the first crown wheel portion so that when the second latch bolt lever is in its first angular orientation, the latch bolt is also in its first angular orientation and when the second latch bolt lever is in its second angular orientation, the latch bolt is also in its second angular orientation, the first and second latch bolt levers being provided with mutually co-operating abutment means enabling to rotate the second latch bolt lever from its first to its second angular orientation by rotating the first latch bolt lever and to rotate the second latch bolt lever from its first to its second angular orientation by rotating the latch bolt without rotating the first latch bolt lever.

11. The lock according to claim 10, wherein the lock comprises a key actuated cylinder provided with a rotary driving bit and a retaining element movable by means of the rotary driving bit between a first position wherein the retaining element engages the first latch bolt lever to obstruct a rotation motion thereof and a second position wherein the retaining element enables the rotation of the first latch bolt lever.

12. A The lock according to any one of claims 1, 10 or wherein said latch bolt is made of at least a first and a second part which are removably fixed to one another, the first and second parts being provided with a screw thread by means of which they are screwed onto one another, the first part comprising at least a head portion which has said lock wing and a part of the shaft portion whilst the second part comprises a part of the shaft portion which is rotatably mounted in the frame and which projects over a distance out of the frame.

13. A lock for a sliding door or gate comprising:

a frame;

a latch bolt comprising a shaft portion and at least one laterally projecting wing on the shaft portion, the shaft portion projecting in a predetermined direction out of the frame and being rotatably mounted on the frame according to a rotation axis extending in said predetermined direction; and a latch bolt operating mechanism arranged to rotate the latch bolt from a first angular orientation, wherein the lock wing of the bolt is in a locking position, to a second angular orientation, wherein the lock wing of the bolt is in an unlocking position and vice versa, the latch bolt operating mechanism comprising a resilient element arranged to urge the latch bolt from its second to its first angular orientation, wherein said wing has a lateral surface defining a screw-like curve around the rotation axis of the latch bolt enabling to convert a translational motion of the latch bolt in said predetermined direction into a rotational motion of the latch bolt from its first to its second angular orientation and wherein the shaft portion of the latch bolt has an end portion by means of which the latch bolt is rotatably mounted in the frame, which end portion is provided with a collar engaging the back side of a cover plate of the lock through which the latch bolt projects out of the frame, the collar being maintained in a circumferential groove formed between the cover plate and a further frame element which is rigidly united with the cover plate so that the latch bolt is secured between the cover plate and the further frame element and rotates in the cover plate and in the further frame element when rotating between said first and second angular orientations.

14. The sliding door or gate provided with a lock according to any one of the claims 1, 10 or 13, further comprising a bolt reception element for receiving and securing the latch bolt of the lock in a locking position, said bolt reception element having a slot having a width that the latch bolt can be guided through the slot in its second angular orientation but that, in the first angular position of the bolt, the lock wing secures the latch bolt behind the slot in the reception element.

15. The sliding door or gate according to claim 14, wherein the bolt reception element comprises a fixed part and a movable part which is provided with said slot, the movable part being movable in a direction forming an angle with the longitudinal direction of the slot, in particular an angle of about 90°.

16. The sliding door or gate according to claim 15, wherein the longitudinal edges of said slot are bevelled.

17. The lock according to claim 6, wherein said screw-like curve has a pitch greater than 210 mm.

18. The lock according to claim 3, wherein said screw-like curve is defined by an edge of the lateral surface of the lock wing.

19. The lock according to claim 12, wherein said first and second parts of the latch bolt are locked by at least one set screw in a predetermined angular orientation to one another.

* * * * *